US005325791A

United States Patent [19]

Atchley et al.

[11] Patent Number: 5,325,791

[45] Date of Patent: Jul. 5, 1994

[54] COUPLING MEANS FOR RAILCAR MOVING VEHICLES

[75] Inventors: Randal L. Atchley; Henry L. Merchant, both of LaGrange; Richard L. Lich, Newnan, all of Ga.

[73] Assignee: Trackmobile, Inc., LeGrange, Ga.

[21] Appl. No.: 737,222

[22] Filed: Jul. 29, 1991

[51] Int. Cl.[5] ..... B61C 11/00

[52] U.S. Cl. ..... 105/75

[58] Field of Search ..... 105/75, 72.2, 26.1, 105/215.2; 213/1 R, 9, 20, 75 R; 280/447, 479.1, 455.1

[56] References Cited

U.S. PATENT DOCUMENTS

| | | | |
|---|---|---|---|
| 3,232,241 | 2/1966 | White | 105/75 |
| 3,540,381 | 11/1970 | White | 105/75 |
| 3,709,153 | 1/1973 | Herscovitch | 105/75 |
| 4,040,507 | 8/1977 | Reise | 280/455.1 |

*Primary Examiner*—Robert J. Oberleitner

*Assistant Examiner*—Kevin D. Rutherford

*Attorney, Agent, or Firm*—Allegretti & Witcoff, Ltd.

[57] ABSTRACT

A coupling mechanism for use on a railcar moving vehicle designed to couple with European-type railway cars having an end sill at each end of the car which supports a centrally disposed draft hook and a pair of buffers mounted one at each end of the end sill, the coupling mechanism including a casting which moves laterally on a plurality of rollers, a crossbar or lifting beam carried on the end of the casting and pivotal relative thereto about a vertical axis, a pair of lifting forks carried on the respective ends of the crossbar, and a pair of buffer plates carried at opposite ends of the crossbar and positioned to push against corresponding buffers on a railway car. The coupling mechanism also includes a sensing device which controls lateral movement of the casting during a pushing or pulling operation in accordance with relative lateral movement of the railcar end sill and buffers.

15 Claims, 3 Drawing Sheets

COUPLING MEANS FOR RAILCAR MOVING VEHICLES

BACKGROUND OF THE INVENTION

The present invention relates to a coupling mechanism for a railcar moving vehicle of the type having road wheels for traveling on road, and rail wheels for traveling on rail, the vehicle being adapted to push or pull one or more railcars along a track when operating on rail. Such railcar moving vehicles typically couple to a railcar to be moved along a track, and they lift the railcar a limited amount to transfer a portion of the weight of the railcar to the railcar moving vehicle to improve the traction of the latter.

The coupling mechanism of the present invention is designed to couple with European-type railway cars having an end sill at each end of the car which supports a centrally disposed draft hook and a pair of buffers mounted one at each end of the end sill. Such a coupling operation involves moving the railcar moving vehicle to a position adjacent to one end of the railcar, engaging buffer plates on the railcar moving vehicle against telescoping cylindrical buffer members on the railcar, causing a hook on the railcar moving vehicle to be engaged with a hook on the railcar, raising the coupling mechanism on the railcar moving vehicle causing lifting forks on the coupling mechanism to partially lift the railcar to transfer a portion of the weight thereof to the railcar moving vehicle, and pulling the railcar moving vehicle hook to pull the railcar up against the railcar moving vehicle causing some compression of the two buffers, after which the railcar moving vehicle may push or pull the railcar and other railcars coupled thereto along the track.

The present invention is an improvement over a coupling mechanism described in White U.S. Pat. No. 3,232,241. The foregoing White patent discloses several embodiments of a coupling mechanism for use on a railcar moving vehicle to couple with a European-type railcar.

In one embodiment shown in FIG. 2 of the White '241 patent, the railcar includes buffers 83 and 84, but the coupling mechanism does not engage against those buffers for the purpose of pushing the railcar. Instead, pushing is achieved through a pair of seat members shown at 39 and 40 in FIG. 2 which engage against the railcar end sill as shown in FIG. 5 to both lift the railcar for weight transfer purposes, and to push the railcar. Additional lifting of the railcar to transfer weight to the railcar moving vehicle is achieved by a pair of lift hooks shown at 66 and 69 in FIG. 3 of the White '241 patent. The lift hooks 66 and 69 lift under the buffer cylinders shown at 86 and 92 in FIG. 3, although those cylinders are of limited strength and not well adapted to permit substantial lifting forces.

In order to permit coupling of the railcar moving vehicle to the railcar for purposes of pulling the latter, FIG. 2 of the White '241 patent shows a hook 101 which is movable vertically so it can be lifted and then laid over in engagement with a draft hook 79 on the railcar, after which a cylinder 98 is used to pull the hook 101 thereby pulling the railcar moving vehicle into firm engagement with the railcar. In the embodiment being described, the end portions 44 of seat members 40 are engaged firmly against the end sill 45 as shown in FIG. 5.

A further feature of the embodiment in FIGS. 1–5 of the White '241 patent involves a double pivot arrangement shown in FIG. 4. The lower square beam 30 carries the seat members 39 and 40 which effect pushing and lifting of the railcar end sill as previously described, whereas the upper beam 52 carries the two lifting hooks shown at 66 and 69 in FIG. 3. It will be seen from FIG. 4 that the lower beam 30 is pivotally mounted about a vertical axis, and the upper beam 52 is similarly pivotal about vertical pin 54. In addition, the rear ends of arms 18 and 50, which carry the beams 30 and 52 at their outer ends, are pivotal about a vertical pivot pin 21. Thus, the arms 18 and 50 are pivotal at their rear ends about vertical pivot pin 21, and the beams 30 and 52 are pivotal about vertical pivot pins at the forward ends of the arms 18 and 50. Such a double pivot arrangement has caused problems when pushing or pulling a railcar around a curve as the structure will tend to buckle or to pivot excessively under certain conditions.

One object of the present invention is to eliminate the need for lifting the buffer cylinders in order to transfer weight to the railcar moving vehicle.

Another object of the present invention is to eliminate pushing against the railcar end sill, but rather to push against the railcar buffers while applying only lifting forces to the railcar end sill.

A further one of our objects is to eliminate the double pivot arrangement disclosed in the White '241 patent.

FIG. 11 of White U.S. Pat. No. 3,232,241 is believed to be the closest prior art to the present invention. In that embodiment, a rigid casting 150 carries a beam 145 which is pivotally mounted on the casting for movement about a central vertical axis 152. The casting 150 is laterally movable by means of rollers shown at 154. However, it is important to understand that during a pushing or pulling operation, the casting 150 is freely movable to float laterally. The lateral movement of casting 150 is controlled by a suitable hydraulic cylinder only during a coupling operation when it is necessary to align the railcar moving vehicle and its coupling mechanism with the end of a railcar to be moved.

FIG. 11 of the White '241 patent also shows pusher plates 146 and 147 on the railcar moving vehicle which engage against corresponding buffers 89″ and 95″ on the railcar. In addition, the White '241 patent explains at column 12, lines 23–33, that lifting of the railcar for weight transfer purposes is accomplished by pads at the opposite end of beam 145 which are adapted for engagement with the underportions of outer cylindrical members 86″ and 92″ of buffers 83″ and 84″.

One further objects of the present invention is to effect pushing of a railcar by use of pusher means engagable against the buffers of a European-type railcar. However, another object is to avoid lifting of the railcar by lifting under those same buffers members, and instead our present invention utilizes lifting forks which engage and lift beneath the end sill of a railcar.

Another important advantage of our invention is the provision of a casting member which is laterally movable on rollers and which carries on one end thereof a beam which is pivotal about a vertical axis at one end of the casting member, the beam carrying both a lifting fork and a pusher plate at each end thereof.

Still another important object of the present invention is to provide means for controlling the lateral position of the above-mentioned casting member during a pushing or pulling operation, such means including sensing means for sensing relative lateral movement between one of said pusher plates and a corresponding buffer member in engagement therewith.

The foregoing and other objects and advantages of the invention will be apparent from the following description of a preferred embodiment thereof, taken in conjunction with the accompanying drawings.

Now, in order to acquaint those skilled in the art with the manner of making and using our invention, we shall describe, in conjunction with the accompanying drawings, a preferred embodiment of our invention.

DETAILED DESCRIPTION OF THE INVENTION

Figure 1:
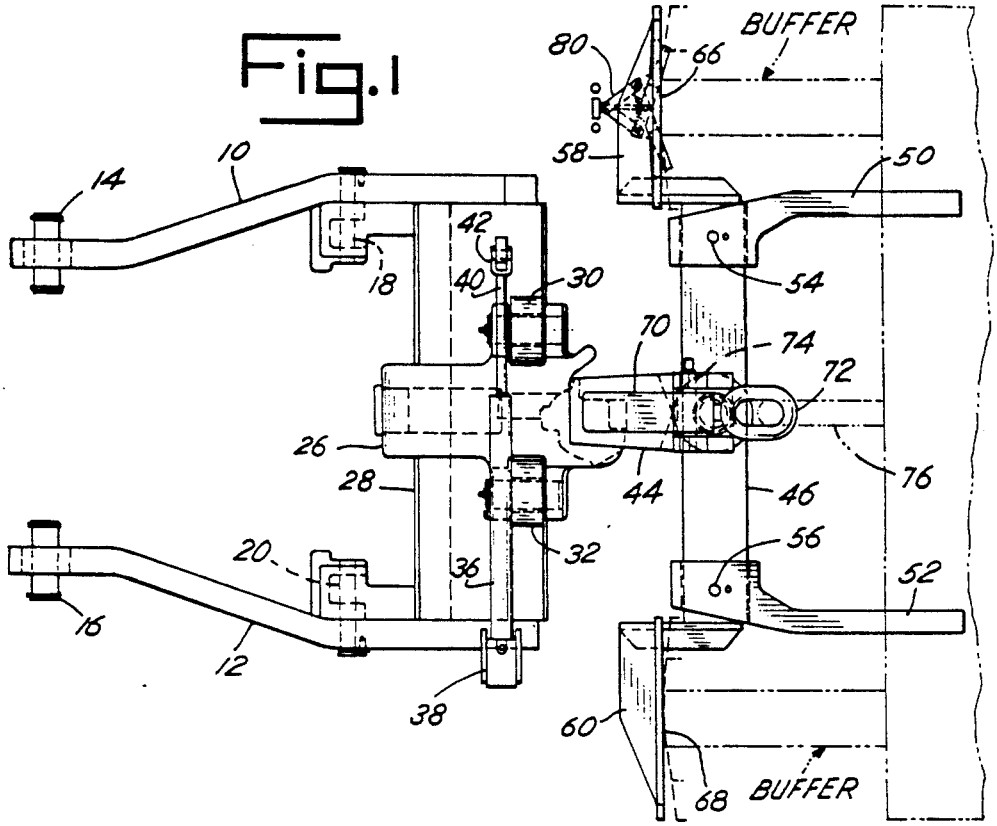
FIG. 1 is a top plan view showing the coupling mechanism for a railcar moving vehicle in accordance with the present invention, there being shown in dotted lines the outline of the end sill of a European-type railcar including a hook and the two compressible buffers associated therewith.

Referring to the drawings, FIG. 1 shows a pair of generally horizontal lifting beams 10 and 12 which are pivotally mounted on respective horizontal pivot pins 14 and 16. The pivot pins 14 and 16 are mounted on an end of the railcar moving vehicle (not shown) and extend toward a railcar to be coupled to the railcar moving vehicle for a pushing or pulling operation along track. The lifting beams 10 and 12 are designed to mount the entire coupler mechanism for coupling to a railcar.

Figure 2:
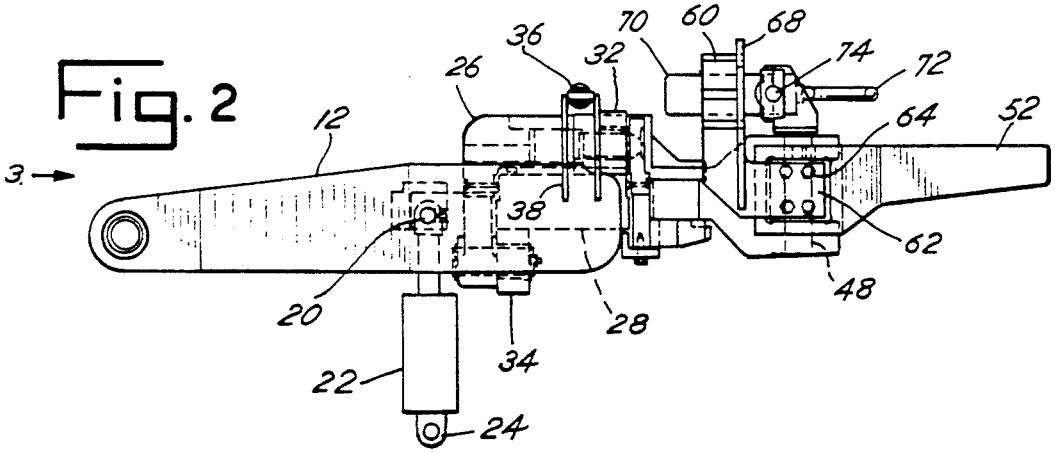
FIG. 2 is a side elevational view of the coupling mechanism of FIG. 1.

A pair of pivot pins 18 and 20 are shown in FIG. 1 for connecting each lifting beam 10 and 12 to a corresponding lift cylinder as shown at 22 in FIG. 2. The lift cylinder 22 includes a lower end 24 which is connected to a rigid portion of the railcar moving vehicle by a pivot pin (not shown), and an upper piston rod connected to the lifting beam 12 by the pivot pin 20. In the foregoing manner, an operator may actuate the two cylinders 22 to raise the two lifting beams 10 and 12 a predetermined amount to partially lift an adjacent railcar and transfer a portion of the weight thereof to the railcar moving vehicle, as will be more fully described hereinafter.

Figure 3:
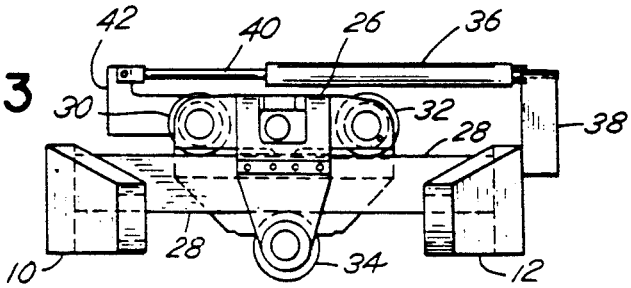
FIG. 3 is a partial end elevational view looking in the direction of the arrows 3—3 of FIG. 2 illustrating a casting member which is laterally slidable on a plurality of rollers, and further illustrating a hydraulic cylinder for controlling lateral movement of the casting member.

A casting member 26 carries three rollers to enable it to roll laterally back and forth on the top of a transverse bar 28 which is fixed between the rear or outer ends of the lifting beams 10 and 12. FIG. 1 shows a pair of laterally spaced rollers 30 and 32 which are carried by the casting 26 and sit on the top of the transverse bar 28. FIGS. 2 and 3 show a third roller 34 which is carried on the casting 26 and engages against the underside of the transverse bar 28. As best shown in FIG. 2, the third roller 34 is longitudinally spaced forwardly from the two upper rollers 30 and 32 to provide resistance against tilting of the casting 26 when lifting forces are applied thereto as hereinafter described.

A traverse cylinder 36 is connected to the casting 26 to control lateral movement thereof. As best shown in FIG. 3, one end of the cylinder 36 is connected to a rigid bracket 38 which is fixed to an end of the lifting beam 12. The other end of a piston rod 40 is connected to a lug 42 which is fixed to the casting 26. Accordingly, actuation of cylinder 36 causes the casting 26 to move laterally along the transverse bar 28 on the rollers 30, 32 and 34.

A traverse cylinder as shown at 36 is known in the art for moving a casting and related coupler mechanism laterally for the purpose of aligning the coupler mechanism with the end of a railcar to be moved. However, such known use of the traverse cylinder 36 has been limited to such alignment of a coupling mechanism with a railcar during a coupling operation. As heretofore used, the traverse cylinder has been disconnected from the casting during a pushing or pulling operation to permit the casting and the coupler mechanism mounted thereon to float laterally along the bar 28.

Some lateral movement of casting 26 during a pushing or pulling operation is desirable. This is particularly true when a railcar is being pushed or pulled around a curve in the track. As the railcar moves around such a curved portion of track, the railcar will turn relative to the railcar moves around such a curved portion of track, the railcar will turn relative to the railcar moving vehicle which tends to separate them at one side of the track and cause undesirable lateral movement of one relative to the other. It is an important feature of our invention that during a pushing or pulling operation the traverse cylinder 36 is operated to control the lateral position of the coupling mechanism of the railcar moving vehicle relative to the railcar as the latter is being pushed or pulled around a curved portion of track.

A rearward shank member 44 is welded to the casting 26 so that casting 26 and shank 44 form a rigid assembly laterally movable along the transverse bar 28 as previously described. Shank 44 has mounted thereon at its rear end a crossbar 46 which can pivot around a vertical pivot pin 48 (see FIG. 2). The crossbar 46 is square in cross-section and lifting forks 50 and 52 are mounted at opposite ends thereof. Each of the lifting forks 50 and 52 has a square opening to permit it to be mounted over a corresponding end of the crossbar 46 and laterally adjusted to a desired position thereon. FIG. 1 shows openings 54 and 56 to receive screw clamps or the like (not shown) which can be used to clamp the lifting forks in a desired lateral position for cooperation with an end sill of a railcar to be lifted.

In addition to the lifting forks 50 and 52, the crossbar 46 carries a pair of buffer plates 58 and 60, one at each end thereof. As best shown in FIG. 2 relative to the buffer plate 60, the plate includes an upright longitudinal plate portion 62 which is affixed to one end of crossbar 46 by a plurality of bolts 64. The other buffer plate 58 is fixed to the opposite end of the crossbar 46 in a similar fashion. The buffer plate 58 includes a rearwardly facing vertical plate portion 66 for engaging against one of the buffers of a railcar, and the buffer plate 60 includes a similar rearwardly facing vertical plate portion 68 for engaging against the other one of the railcar buffers.

Apart from the lateral adjustability of the lifting forks 50 and 52 as previously described, the lifting forks 50 and 52 and the buffer plates 58 and 60 are fixed relative to the crossbar 46. However, the crossbar itself is capable of pivotal movement in a horizontal plane about vertical pivot pin 48 (FIG. 2), and the crossbar 46 is carried on the outer end of shank 44 so that it can be raised and lowered when the two lift cylinders 22 are operated to raise or lower the lifting beams 10 and 12.

The coupling mechanism of the present invention includes a conventional hook link and related cylinders for operating the same. An assembly includes a hook cylinder 70 and a hook link 72 which is attached to a rod portion of the hook cylinder 70 so it can be moved longitudinally by actuation of the hook cylinder. The foregoing assembly is pivotally carried on the outer or rear end of the shank member 44 by a transverse pivot pin 74. As is known in the art, an additional cylinder (not shown) is connected to the foregoing assembly to pivot it about the pin 74 for the purpose of raising or lowering the hook link 72 to enable it to cooperate with a hook 76 associated with a railcar to which the railcar moving vehicle is to be coupled.

As shown in FIG. 1, the buffer plate 58 has sensing mechanism 80 incorporated therein for sensing the relative lateral position between the buffer plate and a railcar buffer in engagement therewith. Before describing the foregoing sensing mechanism, we will first describe the operation of the coupling mechanism shown in FIGS. 1–3.

When it is desired to push or pull one or more railcars along a track, the railcar moving vehicle (not shown) is driven along the track so as to move the coupling mechanism thereon adjacent to an end of the railcar. FIG. 1 shows in dotted lines an end sill of such a railcar and the hook and two buffers which form a part of a European-type railcar, such buffers being somewhat compressible when another car having similar buffers is abutted against them.

As the railcar moving vehicle approaches the buffers and end sill of an adjacent railcar, the operator can activate the traverse cylinder 36 thereby moving the entire casting 26 and components mounted thereon laterally to align the hook link 72 with the hook 76 on the railcar. Once the hook 72 is in the correct position, the operator actuates a cylinder (not shown) which rotates the hook link 72 upwardly to clear the hook 76 on the railcar, and the operator then extends the cylinder 70 to extend the hook 72 to a position where it is disposed immediately over the hook 76. Hook 72 is then permitted to drop over hook 76 into engagement therewith.

Thereafter, the operator actuates the two lift cylinders 22 to raise the two lifting beams 10 and 12 thereby lifting the entire coupling mechanism including the two lifting forks 50 and 52. Thus, in a manner well known in the art, a portion of the weight of the railcar is transferred to the railcar moving vehicle to increase the traction of the latter.

After the lifting operation has been completed to effect weight transfer, the operator retracts cylinder 70 to pull on the link 72, thereby pulling railcar hook 76 to pull the railcar up to the railcar moving vehicle causing the buffer plates 58 and 60 to push against and partially compress the two railcar buffers.

The railcar may then be pushed or pulled by the railcar moving vehicle. During a pushing operation, the buffer plates 58 and 60 push against the two corresponding buffers of the railcar. During a pulling operation, the hook link 72 pulls on the railcar hook 76. During both such operations, the lifting forks 50 and 52 carry a portion of the weight of the railcar. Known means are utilized for controlling the amount of weight carried by the lifting forks 50 and 52. Since the coupling mechanism of the present invention is designed for use with European-type railcars, such known control means will normally control the lift cylinders 22 to allow them to lift the end of the railcar only 25 mm, which is the limit stipulated by the British Railways Code of Practice.

Prior art coupling mechanisms have encountered problems during such pushing or pulling operations when the railcar is moving around a curved portion of track. When moving around a curve, there is a tendency for one of the lifting forks 50 and 52 to pull away from the railcar end sill. Such tendency has been virtually eliminated with the present invention. However, there is also a tendency, for example, during a pushing operation, for the railcar end sill to move toward the outside of the curve relative to the coupling mechanism of the railcar moving vehicle, thereby causing relative lateral movement which is undesirable.

While it is known to provide a casting member such as the member 26 which can move laterally, heretofore such a member was permitted to float laterally during a pushing or pulling operation. Such ability of the casting 26 to float laterally did not prevent relative lateral movement between the coupling mechanism and the railcar when traversing a curve. On the contrary, natural forces tend to cause the casting 26 to move in the opposite direction from the direction of lateral movement of the railcar end sill, thereby exaggerating rather than eliminating such relative lateral movement.

An important feature of the present invention comprises means for controlling the lateral movement of the casting 26 in accordance with lateral movement of the end of the railcar. This feature involves the use of sensing means 80 for sensing any such relative lateral movement, and utilizing such sensing means to operate the traverse cylinder 36 to control lateral rolling movement of the casting 26, rather than permit the casting to float laterally as has been done heretofore. Such sensing mechanism 80 will now be described in conjunction with FIGS. 4–8.

Figure 4:
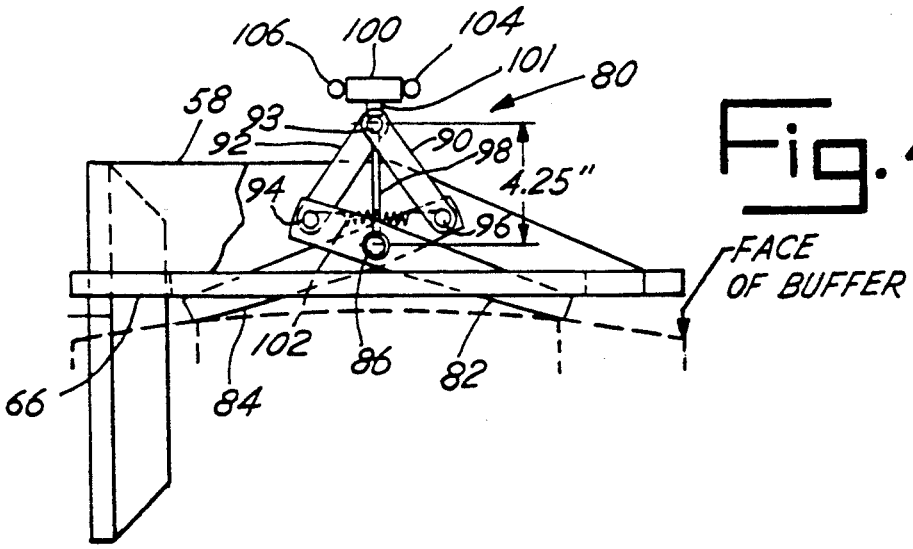
FIG. 4 is a top plan detail view of one of the pusher plates showing sensing mechanism incorporated therein for sensing the lateral position of the pusher plate relative to an engaged buffer on a railcar, the sensing mechanism including a pair of lever members pivotally mounted in a scissors-like arrangement, there being shown in dotted lines the outline of a face of a buffer member which is just beginning to engage the sensing mechanism.
Figure 8:
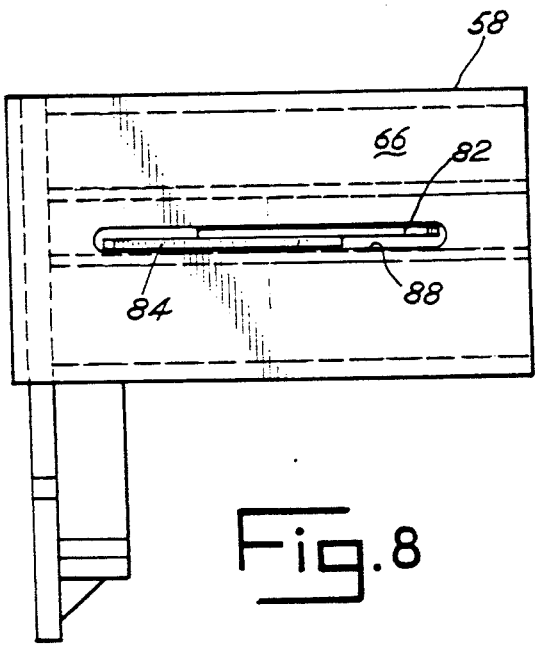
FIG. 8 is an elevational view looking in the direction of the arrows 8—8 of FIG. 7 showing the manner in which the two lever members project through a horizontal slot in one of the buffer plate members.
Figure 7:
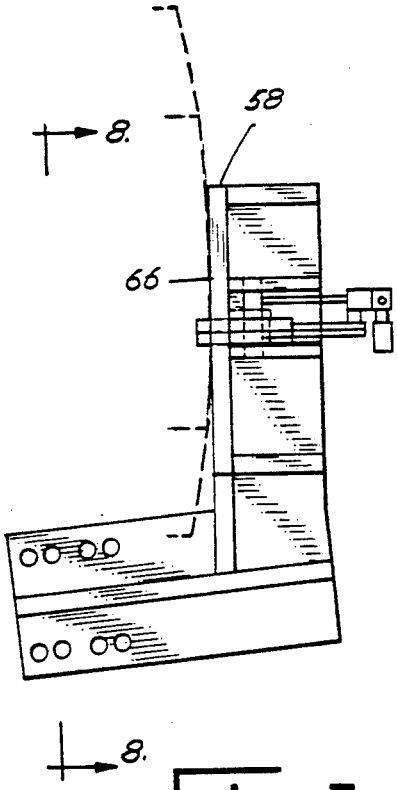
FIG. 7 is a side elevational view illustrating the pusher plate and incorporated sensing mechanism of FIG. 4.

FIG. 4 shows the buffer plate 58 having a face 66 for engagement with the convex face of a railcar buffer. The face of a railcar buffer may be round or oval or rectangular, and the sensing mechanism 80 must be capable of sensing lateral movement of any of those shapes of buffer faces. The mechanism 80 includes a pair of levers 82 and 84 which are pivotally mounted on a common pivot pin 86. The lever 82 is mounted immediately above the lever 84, and as best shown in FIG. 8, the outer ends of the levers project through a horizontal slot 88 in the face 66 of the buffer plate 58.

A second pair of levers 90 and 92 each has one end mounted on a pin 93 and their opposite ends are connected to ends of the corresponding levers 82 and 84 by pins 94 and 96.

A rod 98 is connected at one end of the pivot pin 86, and it passes through the pin 93 and carries on its other end a trip block 100 which includes a mounting sleeve 101. A tension spring 102 is connected between the pins 94 and 96 to bias the sensing components to the position shown in FIG. 4. The pin 93 is slidable along the rod 98, and in the position shown in FIG. 4 it is biased against the trip block mounting sleeve 101.

In the position of the sensing mechanism shown in FIG. 4, the buffer face has not yet deflected the levers 82 and 84 from the positions in which they are biased by the spring 102. However, as the railcar moving vehicle is drawn into contact with the railcar by retraction of the hook cylinder 70 as previously described, the buffer face will engage firmly against the face 66 of the buffer plate 58 as shown in FIG. 5.

Figure 5:
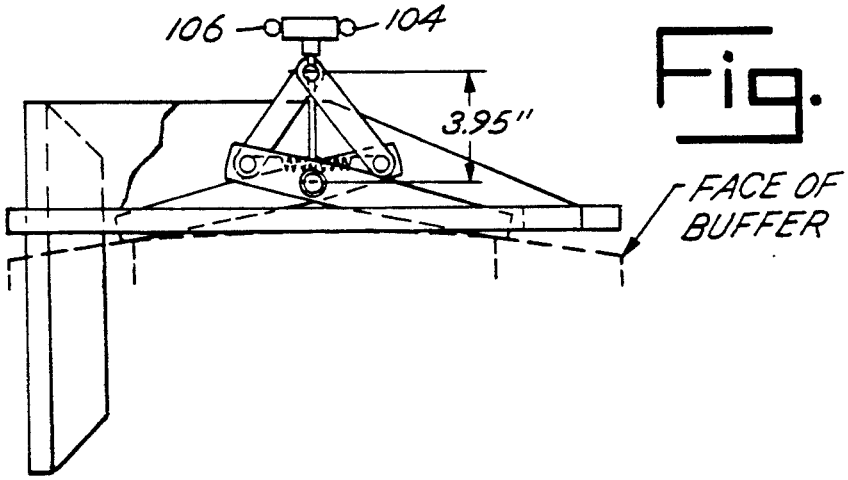
FIG. 5 is a view similar to FIG. 4 showing the buffer face fully engaged with the sensing mechanism as when the railcar moving vehicle is hooked to a railcar and pulled up tight against the railcar to compress the two buffer members.

It is important to understand that the faces of such buffers are convex as shown by the dotted line in FIG. 5, regardless of whether the buffer face is round, oblong or rectangular. Thus, while firm contact is made between the buffer face and the face 66 of buffer plate 58, the area of such contact is not sufficiently wide to cause the levers 84 and 86 to retract fully within the buffer plate face 66. Instead, the levers 82 and 84 will be pivoted from the normal positions of FIG. 4 to the depressed positions of FIG. 5. It will be noted that such pivoting of the levers 82 and 84 causes the pivot pin 93 to slide on rod 98 toward the pivot pin 86, which is demonstrated in FIG. 5 by the dimension of 3.95 inches compared to the dimension of 4.25 inches shown in FIG. 4.

As shown in FIGS. 4 and 5, the trip block 100 is positioned between two switches 104 and 106. In the position shown in those drawings, neither of the two switches is activated. However, if the buffer face shifts a slight distance laterally relative to the buffer plate 58, such shifting movement will cause the sensing mechanism assembly to pivot slightly about the pivot pin 86, thereby causing lateral movement of trip block 100 to effect activation of one of the switches 104 and 106.

Figure 6:
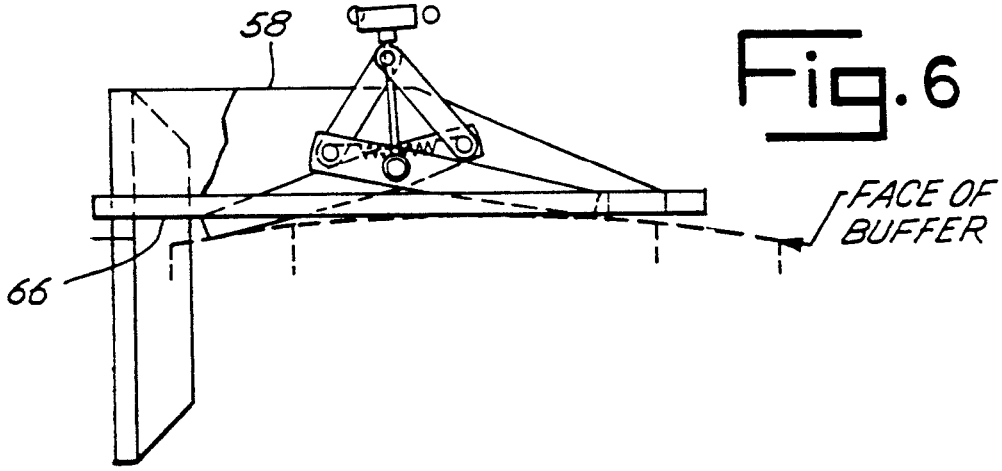
FIG. 6 is a view similar to FIG. 4 showing the face of the buffer member moved to a slight laterally offset position relative to the pusher plate thereby activating the sensing mechanism.

By way of example, FIG. 6 shows the buffer face shifted slightly to the right relative to the face 66 of the buffer plate 58. As a result, lever 86 is depressed further into the horizontal slot 88 in the face 66 of the buffer plate, while lever 84 is pivoted to a position where it projects further. Consequently, the entire sensing mechanism is caused to pivot in a counterclockwise direction causing trip block 100 to move to the left thereby activating switch 106.

In a similar fashion, if the face of the buffer were to shift laterally to the left relative to the face 66 of the buffer plate 58, the sensing mechanism would be caused to rotate about pivot pin 86 in a clockwise direction as viewed in FIG. 6 so as to cause trip block 100 to activate switch 104. We have found that the sensing mechanism of the present invention is readily capable of activating the proper one of the switches 104 and 106 as a result of only one-quarter inch of lateral movement between the buffer face and the face 66 of buffer plate 58.

In accordance with the present invention, the switches 104 and 106 are used to activate traverse cylinder 36 during a pushing or pulling operation, in contrast with the known practice of permitting the casting 26 to float laterally. Thus, referring again to FIG. 1, it is a feature of our invention to move the casting 26 laterally in the same direction as the end of the railcar, i.e., the end sill and buffers. For example, in the top plan view of FIG. 1, if the buffer were to move in the direction of the top of the paper relative to buffer plate 58, switch 106 would be activated to operate traverse cylinder 36 and move casting 26 in the same direction.

Similarly, movement of the buffer face in the opposite direction relative to buffer plate 58 would cause activation of switch 104 which would operate traverse cylinder 36 to move casting 26 in the opposite direction. A feature of the invention is therefore to use the sensing mechanism 80 to activate a selected one of the switches 104 and 106 to operate traverse cylinder 36 to move the casting 26 laterally in the same direction as the railcar end sill and buffers so as to substantially eliminate relative lateral movement between the casting 26 and the railcar end sill and buffers.

It should be understood that any such corrective movement of the casting 26 will continue until the buffer face is again centered relative to the levers 82 and 84 of the sensing mechanism, and any time the buffer face moves out of such a centered position by one-quarter inch, the appropriate one of the switches 104 and 106 will be activated to initiate a corrective lateral movement of casting 26. As a result, the total lateral movement of a buffer relative to a buffer plate with which it is engaged will not normally exceed one-half inch, since corrective action is taken upon movement in either lateral direction of only one-quarter inch.

The foregoing mechanism for causing the casting 26 to follow any lateral movement of the railcar end sill and buffers relative to the casting 26 has been found to be extremely effective when pushing or pulling a railcar around curved track. Such mechanism eliminates lateral movement of the lifting forks 50 and 52 relative to the end sill of the railcar. In addition, the coupling mechanism of the present invention is effective when traversing curves in preventing either of the lifting forks from pulling away from the end sill. Thus, even when negotiating substantially curved track, use of the coupling mechanism of the present invention causes the pusher plates 58 and 60 and the lifting forks 50 and 52 to remain substantially stationary relative to the end sill and buffers of the coupled railcar.

An important advantage of the present invention is that it eliminates any lateral force at the connecting pin 48 where the crossbar 46 is mounted to the outer end of the shank 44. By minimizing any such force, the tendency of the lifting forks 50 and 52 to slip laterally relative to the railcar end sill or to pull out or in at the end sill is eliminated. The coupler assembly is constantly adjusted by the action of the sensing mechanism 80 through any track configuration.

What is claimed is:

1. A coupling mechanism for a railcar moving vehicle intended for coupling to a European-type railcar having an end sill, a draft hook, and a pair of buffers, said coupling mechanism comprising, in combination, longitudinal lifting beam means carried at its inner end by said railcar moving vehicle and pivotal up and down relative thereto about a generally horizontal axis, a transverse bar carried at the outer end of said lifting beam means, casting means supported by said transverse bar for lateral movement relative thereto, crossbar means supported centrally on an outer end of said casting means for pivotal movement about a generally vertical axis, a pair of generally horizontal lifting fork means, one mounted at each end of said crossbar means and extending outwardly therefrom for engagement beneath an end sill of a railcar, and power means for raising and lowering said lifting beam means to raise and lower said lifting fork means, where said casting means is mounted on said transverse bar by a plurality of rollers for rolling movement laterally back and forth on said transverse bar, second power means for controlling the lateral movement of said casting means along said transverse bar, and sensing means for sensing lateral movement of the end of said railcar relative to said coupling mechanism, said sensing means being connected to said second power means to control lateral movement of said casting means in accordance with said relative lateral movement of said railcar.

2. A coupling mechanism as defined in claim 1 where said sensing means controls said second power means to move said casting means laterally in the same direction that the end of said railcar moves relative to said coupling mechanism.

3. A coupling mechanism as defined in claim 1 including a pair of buffer plate means, one mounted at each end of said crossbar for engagement with said pair of buffers to enable said railcar moving vehicle to push said railcar, said sensing means being incorporated into one of said buffer plate means to sense relative lateral movement between said buffer plate means and the railcar buffer engaged therewith.

4. A coupling mechanism for a railcar moving vehicle intended for coupling to a European-type railcar having an end sill, a draft hook, and a pair of buffers, said coupling mechanism comprising, in combination, longitudinal lifting beam means carried at its inner end by said railcar moving vehicle and pivotal up and down relative thereto about a generally horizontal axis, a transverse bar carried at the outer end of said lifting beam means, casting means supported by said transverse bar for lateral movement relative thereto, crossbar means supported centrally on an outer end of said casting means for pivotal movement about a generally vertical axis, a pair of generally horizontal lifting fork means, one mounted at each end of said crossbar means and extending outwardly therefrom for engagement beneath an end sill of a railcar, and power means for raising and lowering said lifting beam means to raise and lower said lifting fork means, said coupling mechanism further comprising a pair of buffer plate means, one mounted at each end of said crossbar means for engagement with said pair of buffers to enable said railcar moving vehicle to push said railcar.

5. A coupling mechanism for a railcar moving vehicle intended for coupling to a European-type railcar having an end sill, a draft hook and a pair of buffers, said coupling mechanism comprising, in combination, longitudinal lifting beam means carried at its inner end by said railcar moving vehicle and pivotal up and down relative thereto about a generally horizontal axis, a transverse bar carried at the outer end of said lifting beam means, casting means supported by said transverse bar for lateral movement relative thereto, lifting fork means carried by said casting means for engagement with said railcar for partially lifting the same, power means for raising said lifting beam means for lifting said railcar, second power means for controlling the lateral movement of said casting means along said transverse bar, and sensing means for sensing lateral movement of the end of a railcar relative to said coupling mechanism, said sensing means being connected to said second power means to control lateral movement of said casting means in accordance with said relative lateral movement of said railcar, whereby said second power means will move said casting means in the same direction as said relative lateral movement of said railcar.

6. A coupling mechanism as defined in claim 5 including a pair of buffer plate means carried by said casting means for engagement with said pair of buffers to enable said railcar moving vehicle to push said railcar, said sensing means being incorporated into one of said buffer plate means to sense relative lateral movement between said buffer plate means and the railcar buffer engaged therewith.

7. A coupling mechanism as defined in claim 6 where said sensing means includes a pair of pivotally mounted lever means which project from said buffer plate means for engagement with the front side portions of a railcar buffer engaged with said buffer plate means whereby lateral movement of said buffer relative to said buffer plate means will deflect said lever means and actuate said sensing means.

8. In a coupling mechanism for a railcar moving vehicle intended for coupling with a railcar for pushing and pulling the same, the railcar moving vehicle being of the type having a casting which is movable laterally from side to side, and power means for controlling the lateral movement of said casting, the improvement comprising, in combination, sensing means for sensing relative lateral movement between the end of a railcar and said coupling mechanism during a pushing or pulling operation, said sensing means being connected with said power means to control the lateral movement of said casting in accordance with said relative lateral movement of said railcar.

9. A coupling mechanism for a railcar moving vehicle intended for coupling to a European-type railcar having an end sill, a draft hook and a pair of buffers, said coupling mechanism comprising, in combination, a pair of generally horizontal lifting beam means carried at their inner ends by said railcar moving vehicle and pivotal up and down relative thereto about a generally horizontal axis, a generally horizontal transverse bar interconnecting the outer ends of said lifting beam means, casting means supported by a plurality of rollers for lateral rolling movement on said transverse bar, generally horizontal crossbar means supported centrally on an outer end of said casting means for pivotal movement about a generally vertical axis, a pair of generally horizontal lifting fork means, one mounted at each end of said crossbar means and extending outwardly therefrom for engagement beneath an end sill of a railcar, a pair of buffer plate means, one mounted at each end of said crossbar means for engagement with said pair of buffers to enable said railcar moving vehicle to push said railcar, power means for raising said pair of lifting beam means to raise said lifting fork means, and second power means for moving said casting means laterally on said transverse bar.

10. A coupling mechanism as defined in claim 9 including sensing means for sensing lateral movement of the end of said railcar relative to said coupling mechanism, said sensing means being connected to said second power means to control lateral movement of said casting means in accordance with said relative lateral movement of said railcar.

11. A coupling mechanism as defined in claim 10 where said sensing means controls said second power means to move said casting means laterally in the same direction that the end of said railcar moves relative to said coupling mechanism.

12. A coupling mechanism as defined in claim 11 where said sensing means is incorporated into one of said buffer plate means to sense relative lateral movement between said buffer plate means and the railcar buffer engaged therewith.

13. A coupling mechanism as defined in claim 12 where said sensing means includes a pair of pivotally mounted lever means which project from said buffer plate means whereby lateral movement of said buffer relative to said buffer plate means will deflect said lever means and actuate said sensing means.

14. A method of pushing or pulling a railcar by means of a railcar moving vehicle which couples to said railcar and lifts a portion of the weight thereof to increase the traction of said railcar moving vehicle, said railcar moving vehicle being of the type having a laterally movable casting which carries lifting means for lifting an end of said railcar, said method including the steps of sensing lateral movement of said railcar relative to said casting during a pushing or pulling operation and moving said casting member laterally in the same direction as said relative lateral movement of said railcar.

15. A method as defined in claim 14 where said sensing step involves sensing lateral movement of a buffer on said railcar relative to a buffer plate on said railcar moving vehicle which is in engagement with said buffer.

* * * * *